US009709357B1

(12) United States Patent
O'Malley

(10) Patent No.: US 9,709,357 B1
(45) Date of Patent: Jul. 18, 2017

(54) FORWARD RAIL GUARD FOR RIFLES

(71) Applicant: Kevin O'Malley, Jacksonville, FL (US)

(72) Inventor: Kevin O'Malley, Jacksonville, FL (US)

( * ) Notice: Subject to any disclaimer, the term of this patent is extended or adjusted under 35 U.S.C. 154(b) by 0 days.

(21) Appl. No.: 15/245,879

(22) Filed: Aug. 24, 2016

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41C 27/00; F41G 11/003
USPC ..... 42/90, 85, 96
See application file for complete search history.

(56) References Cited

U.S. PATENT DOCUMENTS

| | | | | |
|---|---|---|---|---|
| 9,062,933 | B1 * | 6/2015 | Allen | F41G 1/35 |
| 9,341,439 | B2 * | 5/2016 | Michal | F41C 23/16 |
| 9,453,703 | B2 * | 9/2016 | Michal | F41C 23/16 |
| 2015/0096215 | A1 * | 4/2015 | Somogy | F41C 23/16 42/71.01 |

* cited by examiner

*Primary Examiner* — Reginald Tillman, Jr.
(74) *Attorney, Agent, or Firm* — Allen Dyer Doppelt & Gilchrist

(57) ABSTRACT

A rifle assembly includes a rifle and a forward rail guard. The rifle includes a receiver, a barrel extending forwardly of the receiver, and forward rails arranged around a portion of the barrel. The forward rail guard mounted to the forward rails and extending from a rear end proximate the receiver and a forward end extending forwardly of a forward end of the forward rails. The forward rail guard can include left and right guard sections configured to separately connect to left and right side forward rails of the rifle and extend below a barrel thereof.

19 Claims, 5 Drawing Sheets

FORWARD RAIL GUARD FOR RIFLES

FIELD OF THE INVENTION

The present invention relates to rifles, and more particularly, to rifles with rails mounted in the area of a forward grip.

BACKGROUND OF THE INVENTION

Mounting rails are well known in the field of assault rifles and modern sporting rifles. Almost always featuring some type of mounting rail on top of the upper receiver, many such rifles are also either manufactured with, or modified to include, mounting rails in the area where a forward grip would otherwise cover the rear end of the barrel. Quite often, these mounting rails (collectively referred to herein as forward rails) include not only upward-facing rails, but also downward-, leftward- and rightward-facing rails.

While quite convenient for mounting a variety of accessories, these forward rails can be uncomfortable to hold and may offer insufficient protection for a shooter's hand from the heat generated by the forward end of the barrel and metal hardware in thermal contact therewith. To address some of these issues, various rail guards have been offered which afford additional comfort to a shooter; nonetheless, further improvements are possible.

SUMMARY OF THE INVENTION

In view of the foregoing, it is an object of the present invention to provide an improved forward rail guard for rifles. According to an embodiment of the present invention, a rifle assembly includes a rifle and a forward rail guard. The rifle includes a receiver, a barrel extending forwardly of the receiver, and forward rails arranged around a portion of the barrel. The forward rail guard mounted to the forward rails and extending from a rear end proximate the receiver and a forward end extending forwardly of a forward end of the forward rails.

According to an aspect of the present invention, the forward rail guard includes left and right guard sections configured to separately connect to left and right side forward rails of the rifle and extend below a barrel thereof.

These and other objects, aspects and advantages of the present invention will be better appreciated in view of the drawings and following detailed description of preferred embodiments.

DETAILED DESCRIPTION OF PREFERRED EMBODIMENTS

Figure 1:
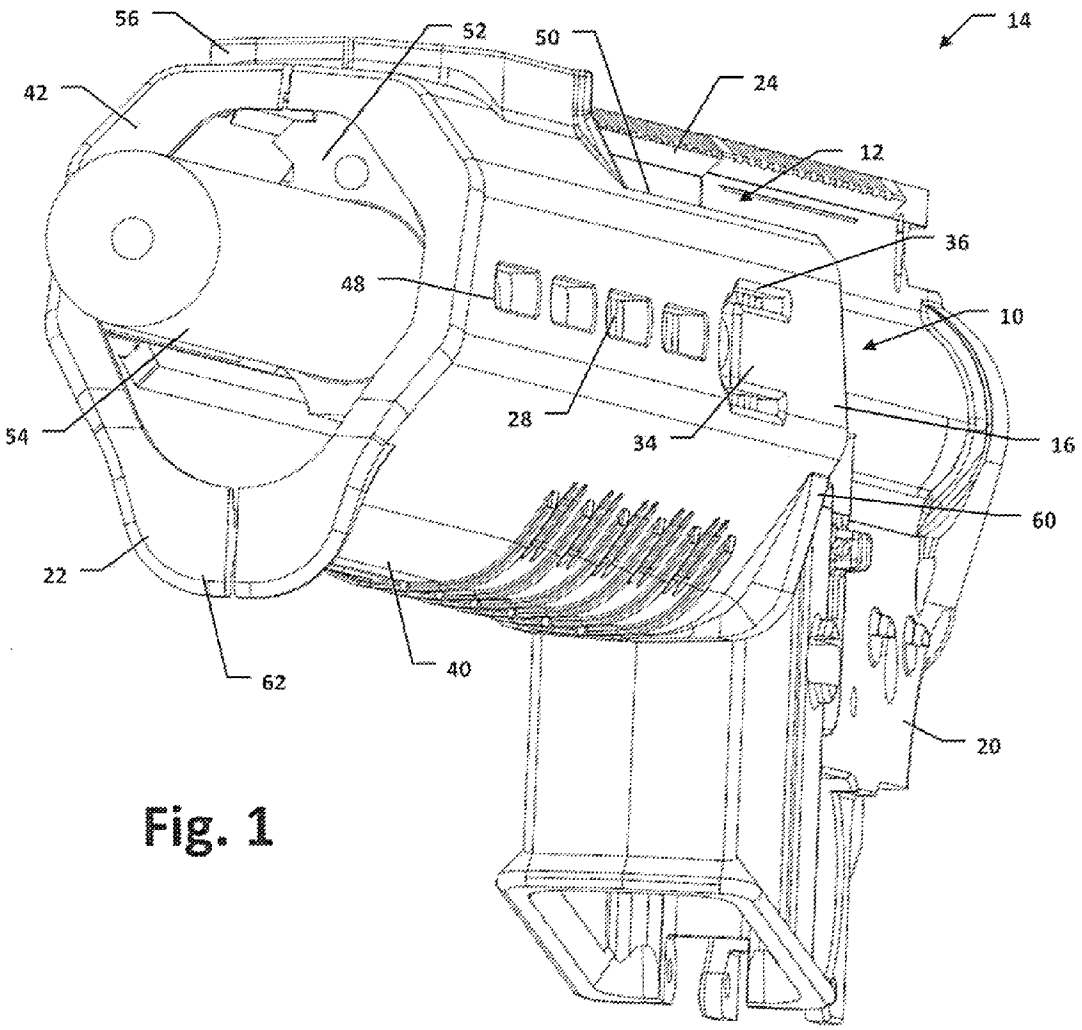
FIG. 1 is a forward perspective view of an rifle with a forward rail guard, according to an embodiment of the present invention.
Figure 2:
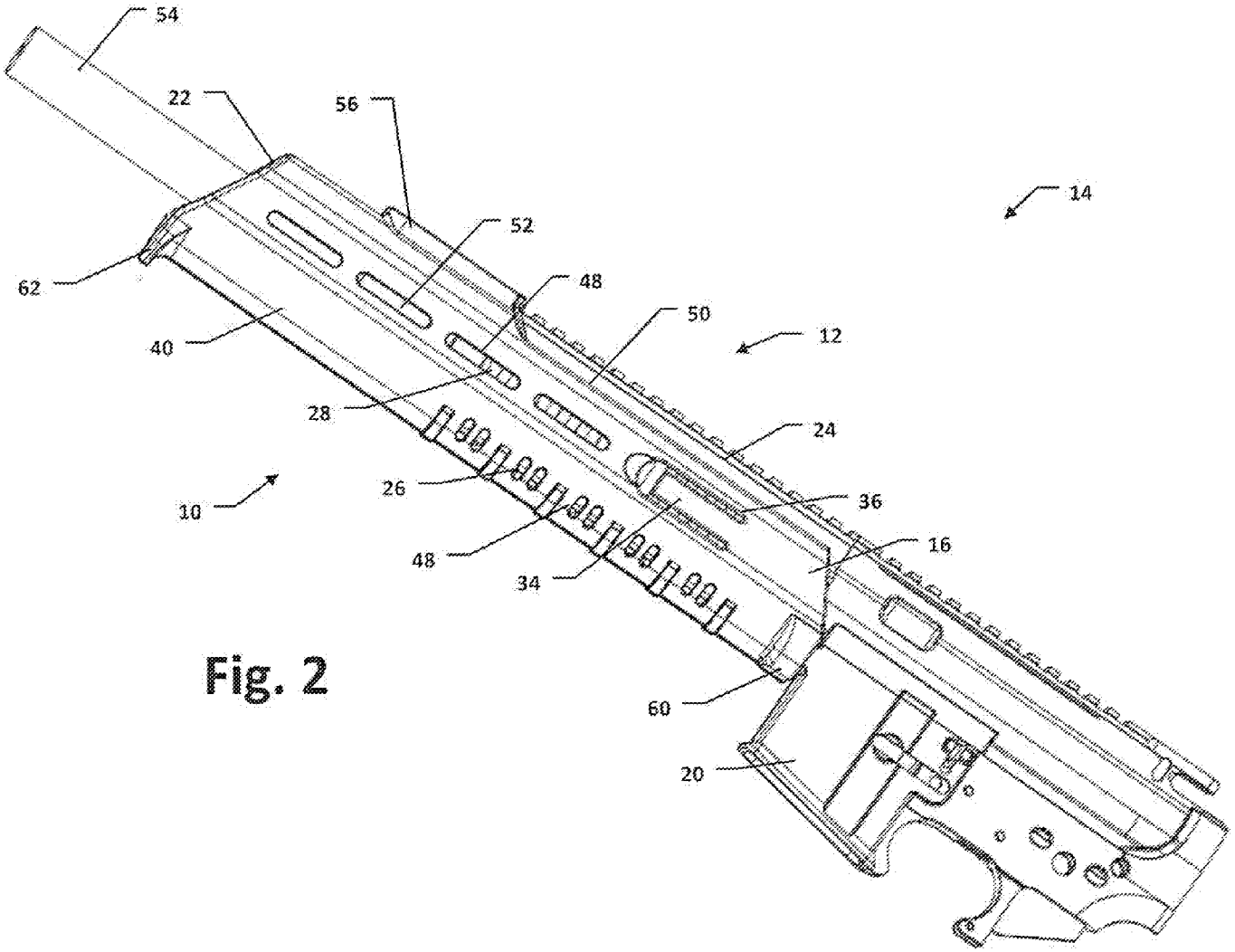
FIG. 2 is a side view of the rifle and forward rail guard of FIG. 1.
Figure 3:
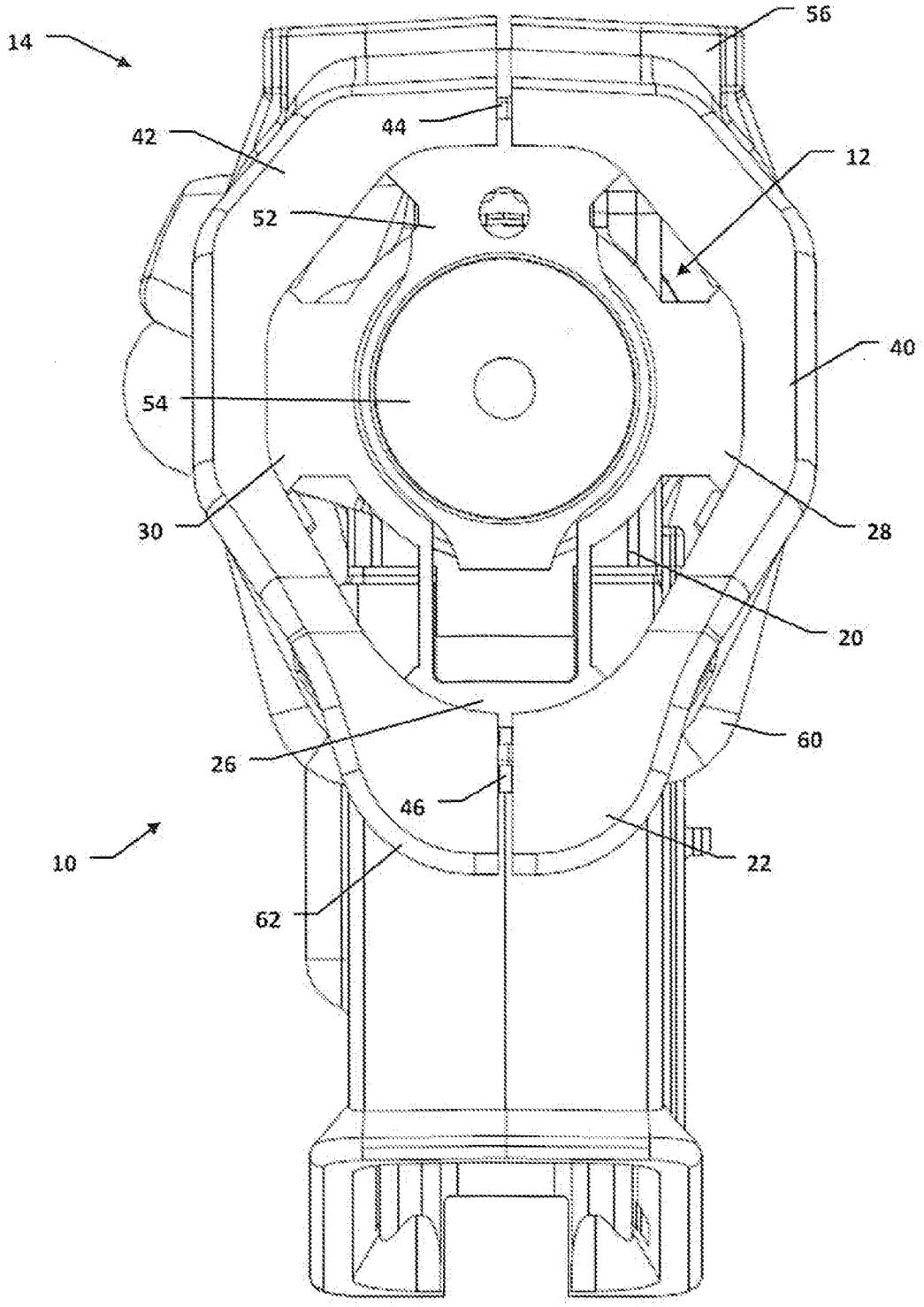
FIG. 3 is a front view of the rifle and forward rail guard of FIG. 1.
Figure 4:
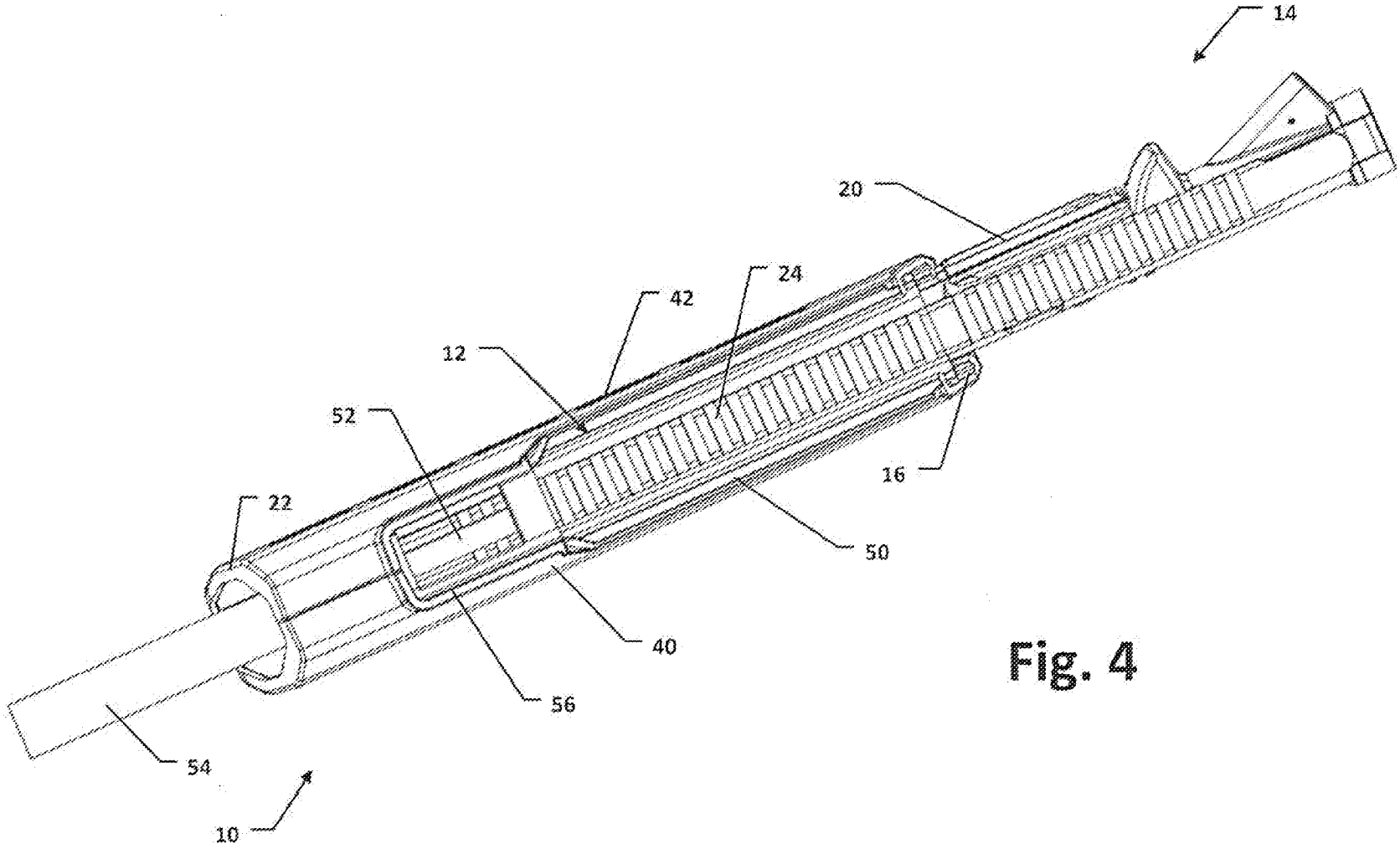
FIG. 4 is an upper perspective view of the rifle and forward rail guard of FIG. 1.
Figure 5:
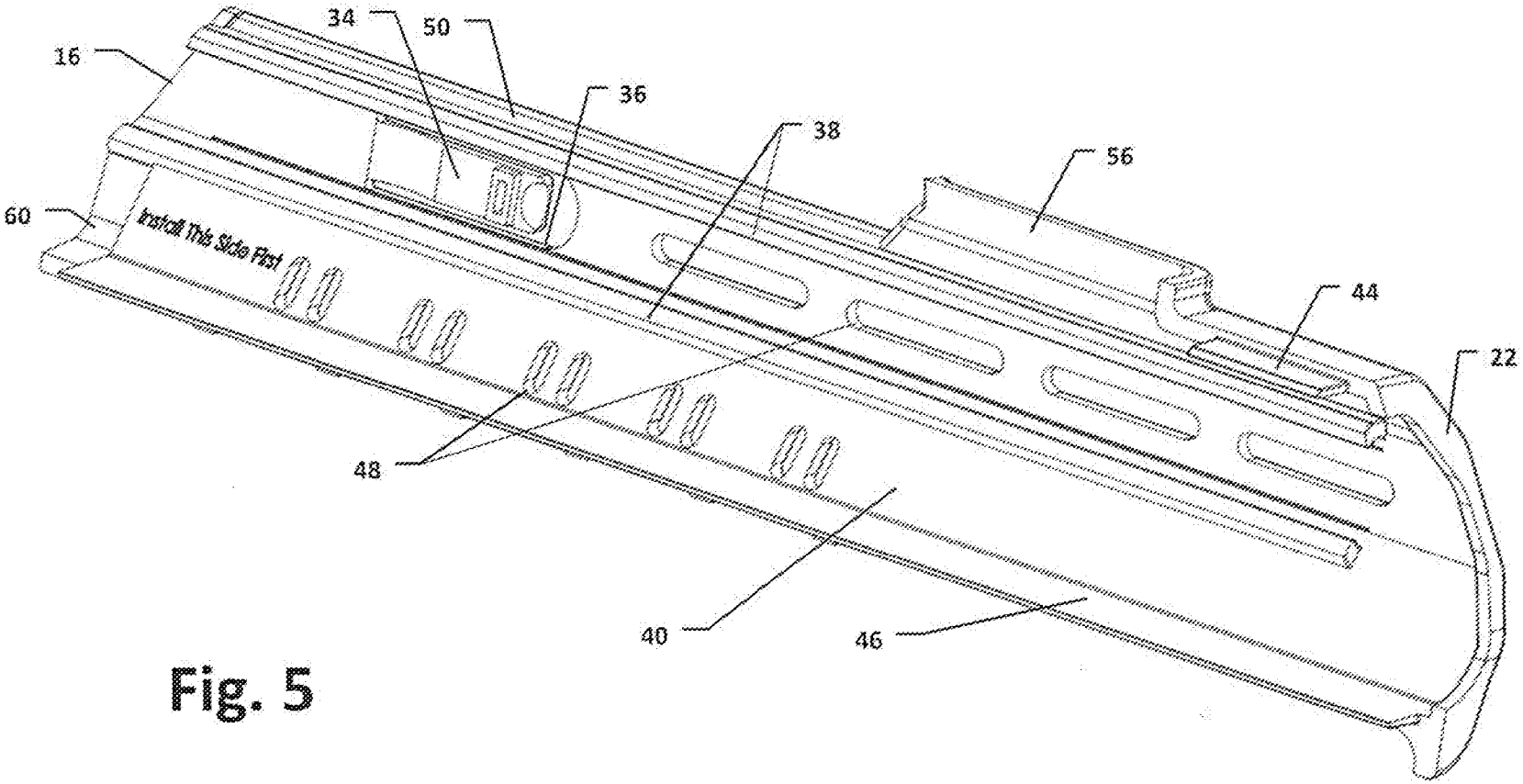
FIG. 5 is an interior side view of a left guard section of the forward rail guard of FIG. 1.

Referring to FIGS. 1-5, a forward rail guard 10 is mounted to the forward rails 12 of a rifle 14. The rail guard 10 extends from a rear end 16 proximate a receiver 20 of the rifle 14 to a forward end 22 that advantageously extends forwardly of a forward end of the forward rails 12. In the depicted embodiment, the forward rails 12 include top, bottom, and left and right side forward rails 24, 26, 28, 30 and the rail guard 10 effectively covers the bottom and left and right side forward rails 26, 28, 30 while leaving the top forward rail 24 accessible.

The rail guard 10 is releasably, slidably mounted to the forward rails 12, and releasably fixed in its fore/aft position by flexible tabs 34 that are biased inwardly to engage the forward rails 12. By manually biasing the tabs 34 outwardly, the rail guard 10 can be moved forward or rearward on the forward rails 12 and ultimately completely removed by sliding off the forward end of the forward rails 12. The tabs 34 are located within cutouts 36 to minimize the likelihood of the tabs 34 catching on other objects. Guide channels 38 on interior sides of the rail guard 10 slidably engage the forward rails 12.

Advantageously, the tabs 34 are located on a rear half of the rail guard 10, while still positioned forwardly of the rear end 16. This positioning facilitates positioning of the rail guard 10 on rifles with relatively short left and right side forward rails 28, 30, and/or left and right side forward rails 28,30 that do not extend rearwardly all the way to the receiver. More forwardly positioned tabs 34 might entirely prevent connection to the rifles with short rails, or at least prevent the rail guard 10 from providing a convenient gripping surface forwardly of the rails. More rearwardly positioned tabs 34 might result prevent the rail guard 10 from offering a convenient gripping surface between rear ends of the rails and the receiver.

More preferably, the rail guard 10 is formed with separate left and right guard sections 40, 42, with the left guard section 40 being slidably received on the left side forward rail 28 and the right guard section 42 being slidably received on the right side forward rail 30. This allows the rail guard 10 to readily mount to the left and right side forward rails 28, 30 of a wide range of rifles without problems arising due to the variation in horizontal spacing resulting from the particular rifle and/or forward rail assembly configuration.

A visible gap between the left and right guard sections 40, 42 is minimized by upper and lower inner flanges 44, 46 extending from one of the guard sections 40, 42 and extending inside of the other. The lower flange 46 preferably runs along substantially the entire length of the rail guard 10, while the upper flange 44 terminates closer to the forward end 22. Thus, the rail guard 10 substantially covers the bottom forward rail 26 between the left and right side forward rails 28, 30. As used herein, "substantially" means not including discrete openings that do not impact the grip, such as the minor gap between sections 40, 42, the cutouts 36 and discrete ventilation openings 48.

Aft of the upper flange 44, an upper opening 50 allows access to the top forward rail 26, as well as a forward sight block mounting area 52 of the barrel 54. A forward wall 56 surrounds the forward sight block mounting area 52, further ensuring a shooter's fingers do not come into contact therewith.

A receiver recess 60 is defined at the rear end 16 of the rail guard 10 proximate the receiver 20. The receiver recess 60 prevents interference with increased width areas on the receiver 20, such as the forward pivot/takedown pin area. A hand-stop 62 is formed at the forward end 22 of the rail guard 10 to help a user tactilely identify the forward end 22 and avoid inadvertently contacting the barrel or coming into proximity with hot gases, projectiles and the like.

In use, a shooter simply slides the left and right guard sections 40, 42 onto the respective left and right side forward rails 28, 30, operating the tabs 34 to slide the sections 40, 42 rearward until the rear end 16 of the guard 10 is in a desired position adjacent the receiver 20. The shooter then uses the rifle 14, as usual, gripping the rail guard 10 as desired. If the shooter wishes to mount other accessories in place of the rail guard 10, removal is readily effected via operation of the tabs 34 while sliding the sections 30, 42 forwardly until clear of the left and right side forward rails 28, 30. Thus, full coverage of the majority of the forward rails 12 is achieved quickly and easily, as well as enhanced protection for the shooter of hot areas of the barrel and thermally connected elements forward of the forward rails 12. The shooter can thus safely grip the rifle 14 at a more forward location.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A rifle assembly comprising;

a rifle including a receiver, a barrel extending forwardly of the receiver, and forward rails arranged around a portion of the barrel; and a forward rail guard mounted to the forward rails and extending from a rear end proximate the receiver to a forward end extending forwardly of a forward end of the forward rails;

wherein the forward rails include left and right side forward rails and the forward rail guard is releasably mounted to the left and right side forward rails; and wherein the forward rail guard is formed of separate left and right guard sections slidably received on the left and right side forward rails, respectively.

2. The rifle assembly of claim 1, wherein the forward rail guard includes guide channels on interior sides thereof, respective pairs of the guide channels slidably engaging the left and right side forward rails.

3. A rifle assembly comprising:

a rifle including a receiver, a barrel extending forwardly of the receiver, and forward rails arranged around a portion of the barrel; and a forward rail guard mounted to the forward rails and extending from a rear end proximate the receiver and a forward end extending forwardly of a forward end of the forward rails;

wherein the forward rails include left and right side forward rails and the forward rail guard is releasably mounted to the left and right side forward rails;

wherein the forward rail guard includes guide channels on interior sides thereof, respective pairs of the guide channels slidably engaging the left and right side forward rails; and wherein the forward rail guard further includes a flexible tab on respective sides thereof, each of the flexible tabs being inwardly biased between one of the respective pairs of guide channels to releasably engage a respective one of the left and right side forward rails to prevent sliding movement thereof.

4. The rifle assembly of claim 3, wherein each of the flexible tabs is located within a respective cutout so as to remain flush with a respective exterior side of the forward rail guard.

5. The rifle assembly of claim 3, wherein each of the flexible tabs is located forward of the rear end of the forward rail guard.

6. The rifle assembly of claim 1, wherein a lower flange extending from one of the left and right guard sections extends inside the other of the left and right guard sections along an underside of the forward rail guard.

7. The rifle assembly of claim 6, wherein the lower flange extends along substantially an entire length of the forward rail guard.

8. The rifle assembly of claim 1, wherein the forward rails further include top and bottom forward rails, and the forward rail guard extends between the left and right side forward rails so as to substantially cover the bottom forward rail.

9. The rifle assembly of claim 8, wherein the forward rail guard defines an upper opening between the left and right side forward rails allowing access to the top forward rail.

10. A rifle assembly comprising:

a rifle including a receiver, a barrel extending forwardly of the receiver, and forward rails arranged around a portion of the barrel; and a forward rail guard mounted to the forward rails and extending from a rear end proximate the receiver and a forward end extending forwardly of a forward end of the forward rails;

wherein the forward rails include left and right side forward rails and the forward rail guard is releasably mounted to the left and right side forward rails;

wherein the forward rails further include too and bottom forward rails, and the forward rail guard extends between the left and right side forward rails so as to substantially cover the bottom forward rail;

wherein the forward rail guard defines an upper opening between the left and right side forward rails allowing access to the top forward rail; and wherein the rifle further includes a forward sight block mounting area arranged on the barrel forward of the forward rails, the upper opening also allowing access to the forward sight block mounting area, the forward rail guard covering an upper portion of the barrel forwardly of the forward sight block mounting area.

11. The rifle assembly of claim 10, wherein the forward rail guard further includes a forward wall at least partially surrounding the forward sight block mounting area.

12. A forward rail guard for a rifle, the forward rail guard comprising:

left and right guard sections configured to separately connect to left and right side forward rails of a rifle and extend below a barrel thereof;

wherein each of the left and right guard sections includes guide channels on respective interior sides thereof, the guide channels configured to slidably engage the left and right forward side rails, respectively; and wherein each of the left and right guard sections includes a flexible tab biased inwardly to engage the left and right forward side rails, respectively, to prevent sliding movement of the left and right guard sections, respectively.

13. The forward rail guard of claim 12, wherein each of the flexible tabs is located with a cutout on the left and right guard sections, respectively, such that the flexible tabs remain flush with an exterior side of the left and right guard sections, respectively.

14. The forward rail guard of claim 12, wherein each of the flexible tabs is located forward of a rear end of the forward rail guard.

15. The forward rail guard of claim 12, wherein a lower flange extends from one of the left and right guard sections inside the other of the left and right guard sections along an underside of the forward rail guard.

16. The rifle assembly of claim 15, wherein the lower flange extends along substantially an entire length of the forward rail guard.

17. The rifle assembly of claim 12, wherein an upper opening is defined between the left and right guard sections allowing access to a top forward rail of the rifle.

18. A forward rail guard for a rifle, the forward rail guard comprising:

left and right guard sections configured to separately connect to left and right side forward rails of a rifle and extend below a barrel thereof;

wherein an upper opening is defined between the left and right guard sections allowing access to a top forward rail of the rifle;

where an upper flange extends from one of the left and right guard sections inside the other of the left and right guard sections forwardly of the upper opening.

19. The rifle assembly of claim 12, wherein a hand-stop is formed on a forward end of the forward rail guard on an underside of at least one of the left and right guard sections.

* * * * *